US011333997B2

(12) United States Patent
Kim et al.

(10) Patent No.: US 11,333,997 B2
(45) Date of Patent: May 17, 2022

(54) DEVELOPER CARTRIDGE BEING CAPABLE OF ADJUSTING INSIDE VOLUME THEREOF

(71) Applicant: HEWLETT-PACKARD DEVELOPMENT COMPANY, L.P., Spring, TX (US)

(72) Inventors: Dong-Uk Kim, Suwon-si (KR); Youngkwang Shin, Suwon-si (KR); Jeong-Sup Sim, Suwon-si (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/264,115

(22) PCT Filed: Aug. 16, 2019

(86) PCT No.: PCT/US2019/046859
§ 371 (c)(1),
(2) Date: Jan. 28, 2021

(87) PCT Pub. No.: WO2020/204982
PCT Pub. Date: Oct. 8, 2020

(65) Prior Publication Data

US 2021/0311409 A1 Oct. 7, 2021

(30) Foreign Application Priority Data

Apr. 1, 2019 (KR) ..... 10-2019-0037690

(51) Int. Cl.
*G03G 15/08* (2006.01)

(52) U.S. Cl.
CPC ..... *G03G 15/087* (2013.01); *G03G 15/0877* (2013.01); *G03G 15/0891* (2013.01);
(Continued)

(58) Field of Classification Search
CPC ..... G03G 15/087; G03G 15/0877; G03G 15/0891; G03G 15/0875; G03G 15/0865;
(Continued)

(56) References Cited

U.S. PATENT DOCUMENTS 5,575,408 A * 11/1996 Marqueling ..... G03G 15/0822 222/412
8,320,797 B2 11/2012 Inomata et al.
(Continued)

FOREIGN PATENT DOCUMENTS

BR PI0905157 3/2011
CN 101414141 4/2009
(Continued)

*Primary Examiner* — Walter L Lindsay, Jr.
*Assistant Examiner* — Laura Roth
(74) *Attorney, Agent, or Firm* — Trop Pruner & Hu, P.C.

(57) ABSTRACT

A developer cartridge including a housing to contain a developer and including a developer outlet from which the developer is dischargeable. A transport member is arranged inside the housing to rotate to transport the developer to the developer outlet. A volume adjustment member is insertable inside the transport member opposite to the developer outlet to adjust an inside volume of the housing.

17 Claims, 10 Drawing Sheets

(52) U.S. Cl.
CPC ..... *G03G 2215/0668* (2013.01); *G03G 2215/0872* (2013.01)

(58) Field of Classification Search
CPC ..... G03G 15/0868; G03G 2215/0827; G03G 15/0867; G03G 2215/066; G03G 2215/0668; G03G 2215/0673; G03G 2215/0678
See application file for complete search history.

(56) References Cited

U.S. PATENT DOCUMENTS

| | | | | |
|---|---|---|---|---|
| 2004/0052538 | A1 | 3/2004 | Yugeta | |
| 2009/0028599 | A1* | 1/2009 | Jun | G03G 15/0881 399/103 |
| 2010/0003055 | A1* | 1/2010 | Kikuchi | G03G 15/0855 399/258 |
| 2011/0081168 | A1* | 4/2011 | Kimura | G03G 15/0872 399/258 |
| 2018/0136583 | A1* | 5/2018 | Park | G03G 21/12 |
| 2018/0157193 | A1* | 6/2018 | Kim | G03G 15/0891 |

FOREIGN PATENT DOCUMENTS

| | | |
|---|---|---|
| EP | 2960721 | 12/2015 |
| JP | 1996123170 | 5/1993 |
| JP | 1993232810 | 9/1993 |
| JP | H09160456 | 6/1997 |
| JP | 2007086093 | 4/2007 |
| JP | 2009031743 | 2/2009 |
| JP | 2013181998 | 9/2013 |
| KR | 1020070021848 | 2/2007 |

* cited by examiner

DEVELOPER CARTRIDGE BEING CAPABLE OF ADJUSTING INSIDE VOLUME THEREOF

BACKGROUND

An electrophotographic image forming apparatus forms a visible toner image on a photoconductor by providing a toner to an electrostatic latent image formed on the photoconductor and transfers the toner image directly to a print medium or via an intermediate transfer medium, thus fixing the transferred toner image to the print medium.

The toner is contained in a developer cartridge as a developer. The developer cartridge is a consumable good that is replaced when the developer in the developer cartridge is consumed. The developer cartridge includes a transport member that transports the developer in the developer cartridge to a developer outlet. When the developer cartridge is mounted on a main body of the image forming apparatus, the transport member is driven by power from the main body.

DETAILED DESCRIPTION OF EXAMPLES

Figure 1:
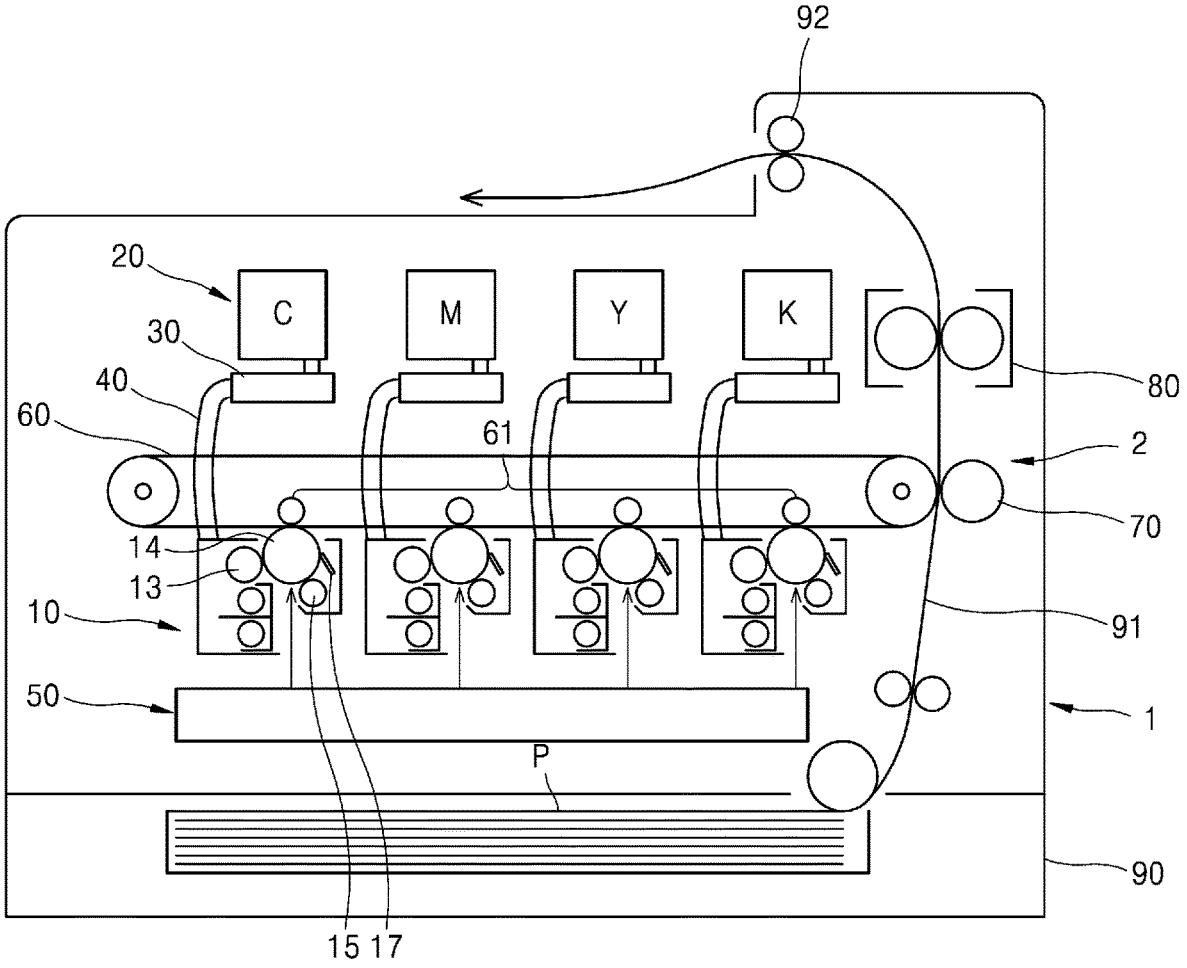
FIG. 1 is a schematic diagram of an example of an electrophotographic printer.

FIG. 1 is a schematic diagram of an example of an electrophotographic printer (an image forming apparatus). Referring to FIG. 1, the printer includes a main body 1 and developer cartridges 20 attachable/detachable to/from the main body 1. The main body 1 includes a print unit 2 that prints an image on a print medium P by using an electrophotographic method. The developer cartridge 20 contains a developer to be provided to the print unit 2. The print unit 2 receives the developer from the developer cartridge 20 and prints the image on the print medium P by using the electrophotographic method.

The print unit 2 according to the present example prints a color image on the print medium P by using the electrophotographic method. The print unit 2 may include developing units 10, an exposure unit 50, a transfer unit, and a fuser 80. The printer may include the developer cartridges 20 containing the developers. The developer cartridges 20 are respectively connected to the developing units 10, and the developers contained in the developer cartridges 20 are respectively provided to the developing units 10. Developer supply units 30 supply the developers, which are received from the developer cartridges 20, to the developing units 10. The developer supply units 30 are connected to the developing unit 10 by supply paths 40. Although not shown in the drawing, the developer supply units 30 may not be included, and the supply paths 40 may directly connect the developer cartridges 20 to the developing units 10.

The developing units 10 may include developing units 10C, 10M, 10Y, and 10K that produce images of cyan (C), magenta (M), yellow (Y), and black (K) colors, respectively. Also, the developer cartridges 20 may include developer cartridges 20C, 20M, 20Y, and 20K that contain cyan, magenta, yellow, and black developers so as to provide such developers to the developing units 10C, 10M, 10Y, and 10K. However, the scope of the disclosure is not limited thereto. The printer may further include developer cartridges 20 and developing units 10 to contain and develop developers of different colors such as light magenta and white.

Hereinafter, the printer including the developing units 10C, 10M, 10Y, and 10K and the developer cartridges 20C, 20M, 20Y, and 20K will be described, and unless otherwise specifically described, C, M, Y, and K added to reference numerals indicate components for developing cyan, magenta, yellow, and black developers.

The developing unit 10 may include a photoconductive drum 14, on which an electrostatic latent image is formed, and a developing roller 13 that provides the developer to the electrostatic latent image and develops the electrostatic latent image as a visible toner image. The photoconductive drum 14 is an example of a photoconductor on which the electrostatic latent image is formed, and may include a conductive metal pipe and a photoconductive layer formed on an outer circumference of the conductive metal pipe. A charging roller 15 is an example of a charger that charges the photoconductive drum 14 to make the photoconductive drum 14 have a uniform electric potential. Instead of the charging roller 15, a charging brush, a corona charger, and the like may be used.

Although not shown in the drawing, the developing unit 10 may further include a charging roller cleaner that removes impurities attached to the charging roller 15 such as the developer or dust, a cleaning member 17 that removes a residual developer on a surface of the photoconductive drum 14 after an intermediate transfer process described below, a regulating member that regulates an amount of the developer provided to a developing area where the photoconductive drum 14 and the developing roller 13 face each other, and the like. The cleaning member 17 may be, for example, a cleaning blade that contacts the surface of the photoconductive drum 14 and removes the developer. Although not shown, the cleaning member 17 may be a cleaning brush that contacts the surface of the photoconductive drum 14 while rotating and scraps the developer.

The developer, for example, a toner and a carrier, which is contained in the developer cartridge 20 is provided to the developing unit 10. The developing roller 13 may be apart from the photoconductive drum 14. A distance between an outer circumferential surface of the developing roller 13 and an outer circumferential surface of the photoconductive drum 14 may be, for example, several ten to hundred microns. The developing roller 13 may be a magnetic roller. Also, the developing roller 13 may have a structure in which a magnet is disposed inside a rotary developing sleeve. In the developing unit 10, the toner is mixed with the carrier and attached to a surface of a magnetic carrier. The magnetic carrier is attached to a surface of the developing roller 13 and transported to the developing area where the photoconductive drum 14 and the developing roller 13 face each other. A regulating member (not shown) regulates an amount of the developer transported to the developing area. Due to a developing bias voltage applied between the photoconductive drum 14 and the developing roller 13, only the toner is supplied to the photoconductive drum 14 and develops the electrostatic latent image, which is formed on the surface of the photoconductive drum 14, as the visible toner image.

The exposure unit 50 irradiates light, which is modulated corresponding to image information, onto the photoconductive drum 14, and the electrostatic latent image is formed on the photoconductive drum 14. Examples of the exposure unit 50 include a laser scanning unit (LSU) using laser diodes as a light source, a light emitting diode (LED) exposure unit using LEDs as a light source, and the like.

A transfer unit transfers a toner image, which is formed on the photoconductive drum 14, to the print medium P. In the present example, a transfer unit using an intermediate transfer method is employed. For example, the transfer unit may include an intermediate transfer belt 60, an intermediate transfer roller 61, and a transfer roller 70.

The intermediate transfer belt 60 temporarily contains the toner images developed on the photoconductive drums 14 of the developing units 10C, 10M, 10Y, and 10K. The intermediate transfer rollers 61 are disposed at locations facing the photoconductive drums 14 of the developing units 10C, 10M, 10Y, and 10K with the intermediate transfer belt 60 therebetween. To the intermediate transfer rollers 61, an intermediate transfer bias voltage is applied to intermediate-transfer the toner images, which are developed on the photoconductive drums 14, to the intermediate transfer belt 60. Instead of the intermediate transfer rollers 61, corona transfer units or transfer units using a pin scorotron method may be employed.

The transfer roller 70 may be at a location facing the intermediate transfer belt 60. To the transfer roller 70, a transfer bias voltage for transferring the toner images, which are transferred to the intermediate transfer belt 60, to the print medium P may be applied.

The fuser 80 may apply heat and/or pressure to the toner images transferred to the print medium P, thus fixing the toner images to the print medium P. Shapes of the fuser 80 are not limited to the example of FIG. 1.

Due to the above structure, the exposure unit 50 irradiates light beams, which are modulated corresponding to image information of each color, onto the photoconductive drums 14 of the developing units 10C, 10M, 10Y, and 10K, thereby forming the electrostatic latent images on the photoconductive drums 14. Due to the C, M, Y, and K developers provided from the developer cartridges 20C, 20M, 20Y, and 20K to the developing units 10C, 10M, 10Y, and 10K, the electrostatic latent images formed on the photoconductive drums 14 of the developing units 10C, 10M, 10Y, and 10K are developed as the visible toner images. The developed toner images are sequentially intermediate-transferred to the intermediate transfer belt 60. The print medium P loaded on a loading member 90 is transported along a feeding path 91 and transported between the transfer roller 70 and the intermediate transfer belt 60. Due to the transfer bias voltage applied to the transfer roller 70, the toner images, which are intermediate-transferred to the intermediate transfer belt 60, are transferred to the print medium P. When the print medium P passes through the fuser 80, the toner images are fixed to the print medium P by heat and pressure. The print medium P, to which the toner images are fixed, is discharged by a discharge roller 92.

The developer cartridges 20 may be attachable to/detachable from the main body 1 and may be individually replaced. When the developer contained in the developer cartridge 20 is consumed, the developer cartridge 20 may be replaced with a new developer cartridge 20. When a one-component developer is employed, the developer contained in the developer cartridge 20 may be a toner. When a two-component developer is employed, the developer contained in the developer cartridge 20 may be a toner or may be a toner and a carrier. The developer cartridge 20 may be referred to as a 'toner cartridge'.

Figure 2:
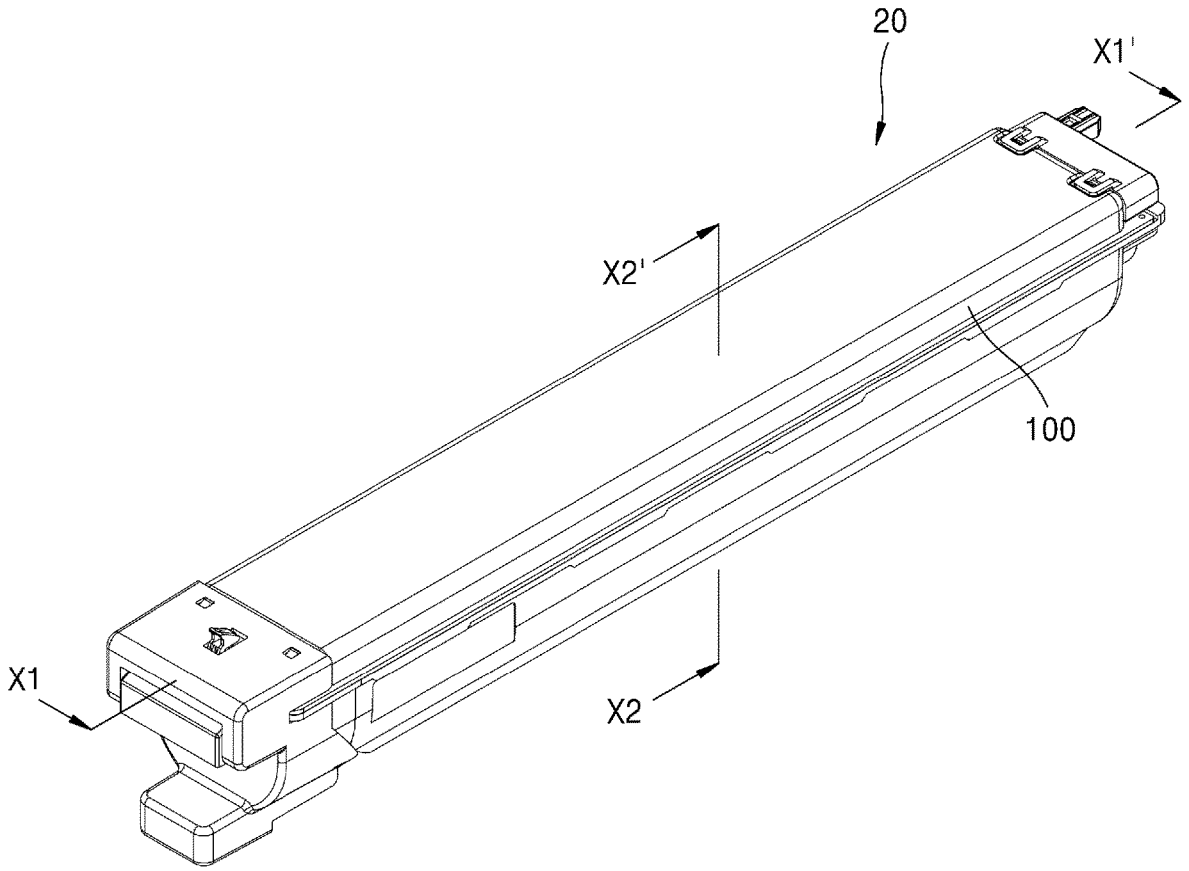
FIG. 2 is a perspective view of an example of a developer cartridge.
Figure 3:
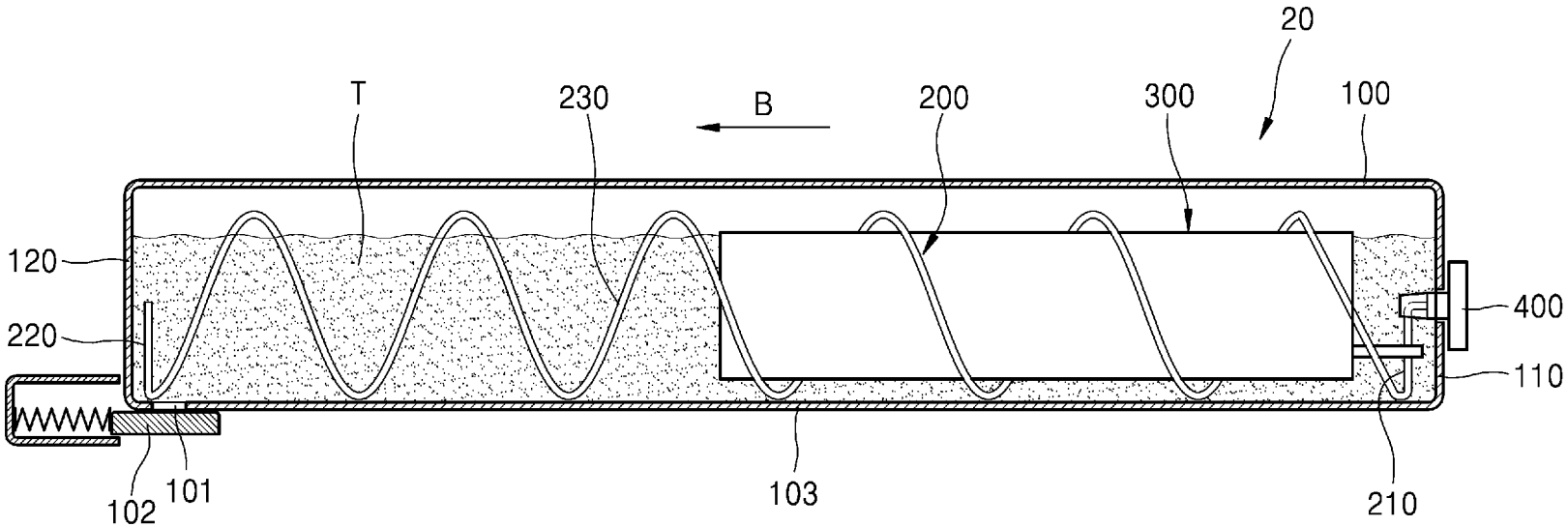
FIG. 3 is a cross-sectional view taken along a line X1-X1' of FIG. 2.
Figure 4:
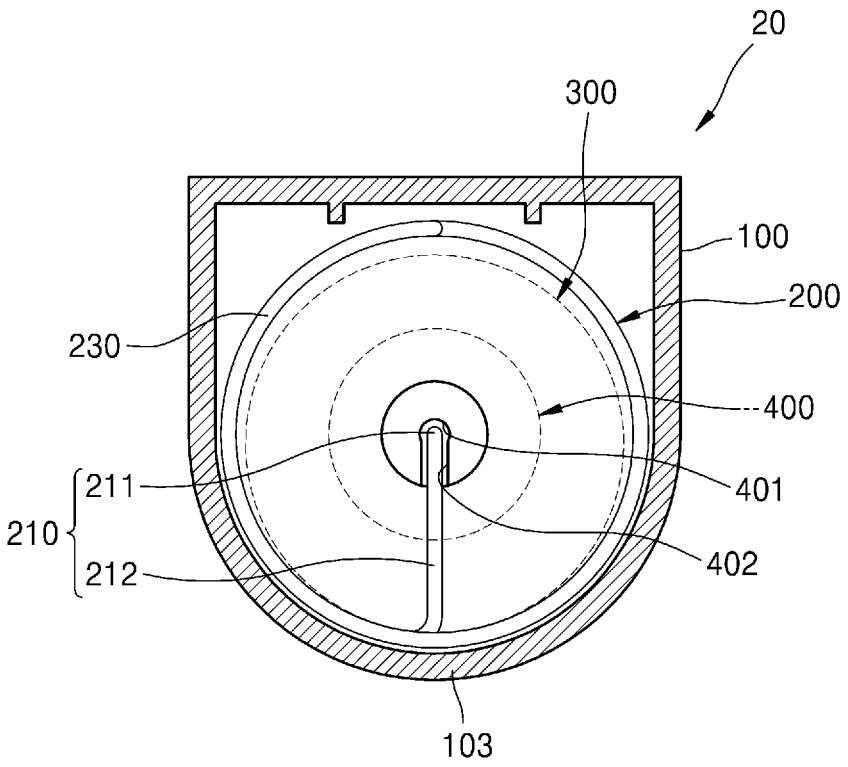
FIG. 4 is a cross-sectional view taken along a line X2-X2' of FIG. 2.

FIG. 2 is a perspective view of an example of the developer cartridge 20. FIG. 3 is a cross-sectional view taken along a line X1-X1' of FIG. 2. FIG. 4 is a cross-sectional view taken along a line X2-X2' of FIG. 2. Referring to FIGS. 2, 3, and 4, the developer cartridge 20 may include a housing 100, a spring auger 200, and a volume adjustment member 300. The housing 100 contains a developer.

In an end portion of the housing 100 in a lengthwise direction B, a developer outlet 101 is formed to discharge the developer. The housing 100 includes a first end portion 110 and a second end portion 120 that are apart from each other in the lengthwise direction B. The developer outlet 101 may be at a location adjacent to any one of the first end portion 110 and the second end portion 120. The developer outlet 101 may be disposed adjacent to a downstream end portion among the first end portion 110 and the second end portion 120 with respect to a direction of transporting the developer by the spring auger 200. In the present example, the developer outlet 101 is adjacent to the second end portion 120. On an outer portion of the developer outlet 101, a shutter 102 selectively opening or closing the developer outlet 101 may be disposed. The developer may be provided to the developing unit 10 through the developer outlet 101. The supply path (40 of FIG. 1) may be connected to the developer outlet 101. The developer outlet 101 may also be connected to the developer supply unit (30 of FIG. 1). Also, although not shown in the drawings, the developer outlet 101 may be directly connected to the developing unit 10.

The spring auger 200 is an example of a transport member that is disposed inside the housing 100 and transports the developer to the developer outlet 101 while rotating. The spring auger 200 may be in a form of a spiral coil, as shown in FIG. 3. A rotation member 400 is disposed on the first end portion 110 of the housing 100, is connected to the spring auger 200, and rotates the spring auger 200.

An end portion 210 of the spring auger 200 may be connected to the rotation member 400. Referring to FIGS. 3 and 4, an example of a connection structure of the rotation member 400 and the spring auger 200 will be described. The spring auger 200 may include a connection portion 211 connected to the rotation member 400, an extension portion 212 extending in a radial direction from the connection portion 211, and a spiral portion 230 extending in a spiral form towards the second end portion 120 of the housing 100 in the lengthwise direction B from the extension portion 212. The end portion 210 of the spring auger 200 may include the connection portion 211 and the extension portion 212. The other end portion 220 of the spring auger 200 is an end portion opposite the end portion 210 with the spiral portion 230 therebetween.

The connection portion 211 may extend, for example, in an axis direction of the spring auger 200. The connection portion 211 may be, for example, inserted into an insertion hole 401 formed in the rotation member 400. The extension portion 212 is inserted into a slit 402 that is cut in the radial direction. When the rotation member 400 rotates, a sidewall of the slit 402 pushes the extension portion 212, and the spring auger 200 rotates. The rotation member 400 may be, for example, gear, a coupler, or the like. When the developer cartridge 20 is mounted on the main body 1, the rotation member 400 may be connected to a driving member disposed in the main body 1, for example, gear, a coupler, or the like.

The other end portion 220 of the spring auger 200 may be a free end that is not bound to the housing 100. In other words, as shown in FIG. 3, the other end of the spring auger 200 may not be connected to the second end portion 120 of the housing 100 and may be adjacent to the second end portion 120 of the housing 100.

When the spring auger 200 rotates, the spiral portion 230 of the spring auger 200 transports the developer in the housing 100 in the lengthwise direction B while contacting the bottom 103 of the housing 100 and transports the developer towards the developer outlet 101.

The amount of the developer contained in the housing 100 may be adjusted depending on characteristics of a market. When a small amount of the developer is contained in the housing 100, the developer may be slanted towards an opposite side of the developer outlet 101, for example, the first end portion 110. In this case, since no developers or few developers exist around the developer outlet 101 in an initial state in which the developer cartridge 20 is mounted on the main body 1, a sufficient amount of the developer may not be provided to the main body 1, that is, the developing unit 10. The spring auger 200 driving to drive for a relatively long time to transport a sufficient amount of the developer to the developer outlet 101.

A length of the developer cartridge 20, that is, a length of the housing 100, may be adjusted to be short or long in accordance with the amount of developer to be contained therein, but in this case, different types of developer cartridges 20 having housings 100 of different lengths need to be prepared. Also, the developer outlet 101 is disposed adjacent to the first end portion 110 or the second end portion 120 of the housing 100 according to a location of the supply path 40 or the developer supply unit 30 included in the main body 1, and the rotation member 400 is also disposed adjacent to the first end portion 110 or the second end portion 120 of the housing 100 according to a location of the gear, the coupler, and the like included in the main body 1. When the length of the housing 100 differs, the locations of the developer outlet 101 and the rotation member 400 may differ, and the locations of the supply path 40, the developer supply unit 30, the gear, the coupler, and the like may differ accordingly. In this case, according to markets, various types of main bodies 1 capable of housing the various types of developer cartridges 20 need preparing.

In order to satisfy needs of various markets by using one developer cartridge 20 and one main body 1, the developer cartridge 20 according to the present embodiment includes a volume adjustment member 300 that is disposed adjacent to the other end portion of the housing 100, which is opposite the developer outlet 101, and adjusts an inside volume of the hosing 100. In the present embodiment, as shown in FIG. 3, the volume adjustment member 300 is disposed adjacent to the first end portion 110 of the housing 100.

Due to the above structure, the inside volume of the housing 100 decreases by as much as a volume of the volume adjustment member 300. The developer is contained in a portion of the housing 100 excluding the volume of the volume adjustment member 300. Since the volume adjustment member 300 is adjacent to the first end portion 110 opposite the developer outlet 101, the developer is housed between the second end portion 120 including the developer outlet 101 and the volume adjustment member 300. Since the developer exists near the developer outlet 101, a sufficient amount of the developer may be supplied to the main body 1, that is, the developing unit 10, in an initial state in which the developer cartridge 20 is mounted on the main body 1.

Also, the volume adjustment member 300 having an appropriate size is disposed in the housing 100 according to an amount of the developer contained in the housing 100, and thus one developer cartridge 20 and one main body 1 may be used in various markets.

Figure 5:
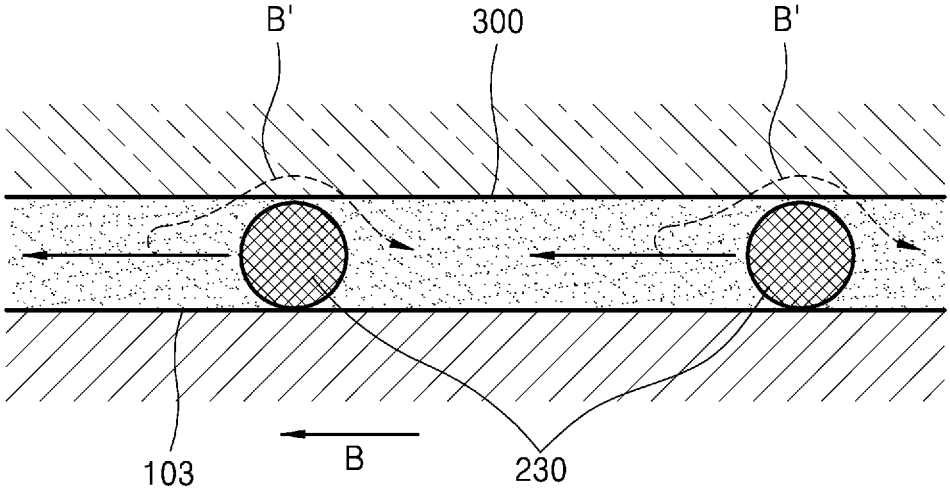
FIG. 5 is a diagram showing how a developer is transported by a spring auger.

The volume adjustment member 300 may be inserted into the spring auger 200. The volume adjustment member 300 fills an inner space of the spring auger 200. FIG. 5 is a diagram showing how the developer is transported by the spring auger 200. Referring to FIG. 5, when the spring auger 200 rotates, the developer is pushed by the spiral portion 230 of the spring auger 200 and transported in the lengthwise direction B. In this case, when there is an inner space, the developer may be pushed over the spiral portion 230 in a reverse direction, as indicated by the reference numeral B' in FIG. 5. According to the present embodiment, since the volume adjustment member 300 fills the inner space of the spring auger 200, the developer is not pushed in the reverse direction. Therefore, the ability to transport the developer by the spring auger 200 may be improved.

Figure 6:
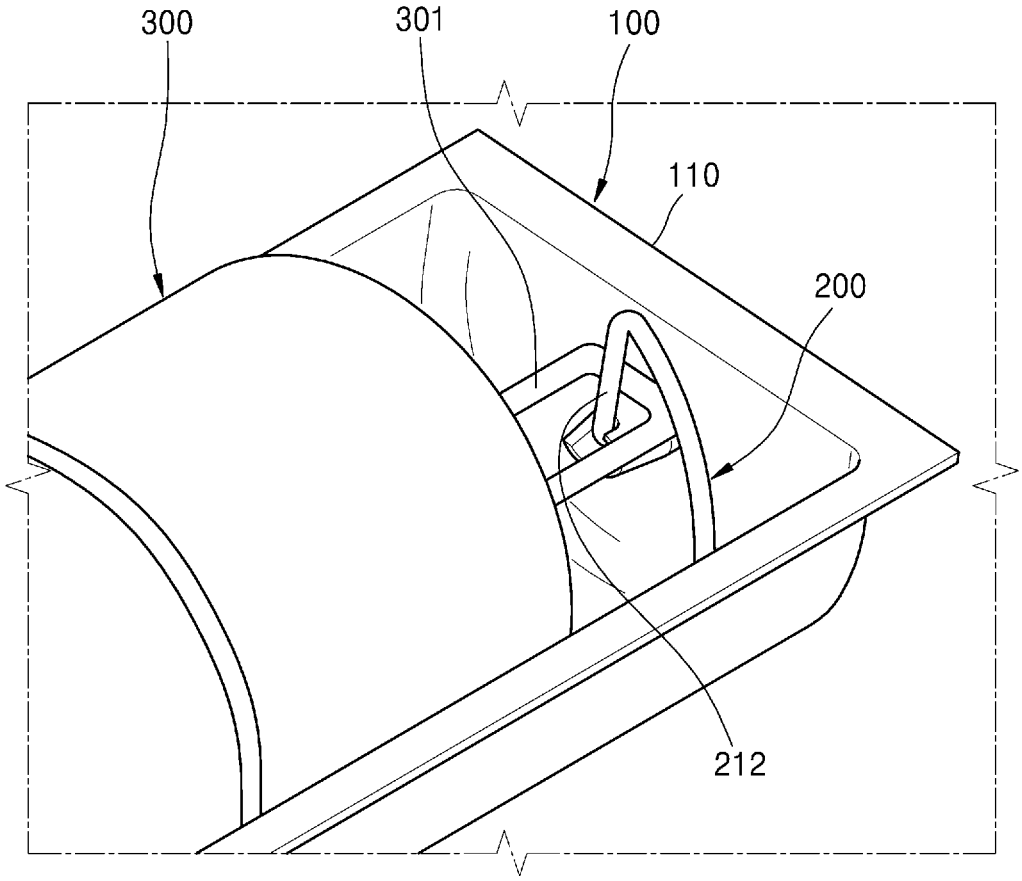
FIG. 6 shows an example of a connection structure of a volume adjustment member and a spring auger.

The volume adjustment member 300 may rotate together with the spring auger 200. For example, the volume adjustment member 300 may be connected to the spring auger 200 and rotate together with the spring auger 200. FIG. 6 shows an example of a connection structure of the volume adjustment member 300 and the spring auger 200. Referring to FIG. 6, the volume adjustment member 300 may be connected to the extension portion 212 of the spring auger 200. A connection ring 301 may be on one end portion of the volume adjustment member 300. The extension portion 212 of the spring auger 200 is coupled to the connection ring 301. Therefore, the volume adjustment member 300 may rotate together with the spring auger 200. A size of the connection ring 301 is greater than a wire diameter of the spring auger 200 forming the extension portion 212. Thus, the volume adjustment member 300 may be connected to the extension portion 212 of the spring auger 200 to be movable in the radial direction.

The volume adjustment member 300 may include an antiskid member connected to the spring auger 200 to prevent the volume adjustment member 300 from being pushed towards the developer outlet 101 due to the thrust generated as the spring auger 200 rotates. The antiskid member may include the connection ring 301 connected to the spring auger 200 so that the antiskid member is movable in the radial direction. That is, the connection ring 301 may have a function of rotating the volume adjustment member 300 together with the spring auger 200 and a function of preventing the volume adjustment member 300 from being pushed towards the developer outlet 101.

Due to the above structure, the volume adjustment member 300 may not be pushed towards the developer outlet 101 and may remain adjacent to the first end portion 110. Also, as shown in FIG. 4, the volume adjustment member 300 moves in the radial direction due to the gravity and located close to the bottom 103 of the housing 100. The developer is mainly transported by the spiral portion 230 of the spring auger 200 contacting the bottom 103 of the housing 100. The volume adjustment member 300 contacts the spiral portion 230 of the spring auger 200 contacting the bottom 103 of the housing 100 in an opposite side of the bottom 103 of the housing 100. Therefore, as indicated by the reference numeral B' in FIG. 5, the developer that is pushed over the spiral portion 230 in the reverse direction is blocked by the volume adjustment member 300, and thus the ability to transport the developer by the spring auger 200 may be improved.

The volume adjustment member 300 may have an adjustable length. The volume adjustment member 300 is installed in the housing 100 by adjusting the length of the volume adjustment member 300 depending on characteristics of markets, and thus, the volume of the housing 100 may fit with the amount of a contained developer. Therefore, various demands of markets may be satisfied by using one volume adjustment member 300 having the adjustable length.

Figure 7:
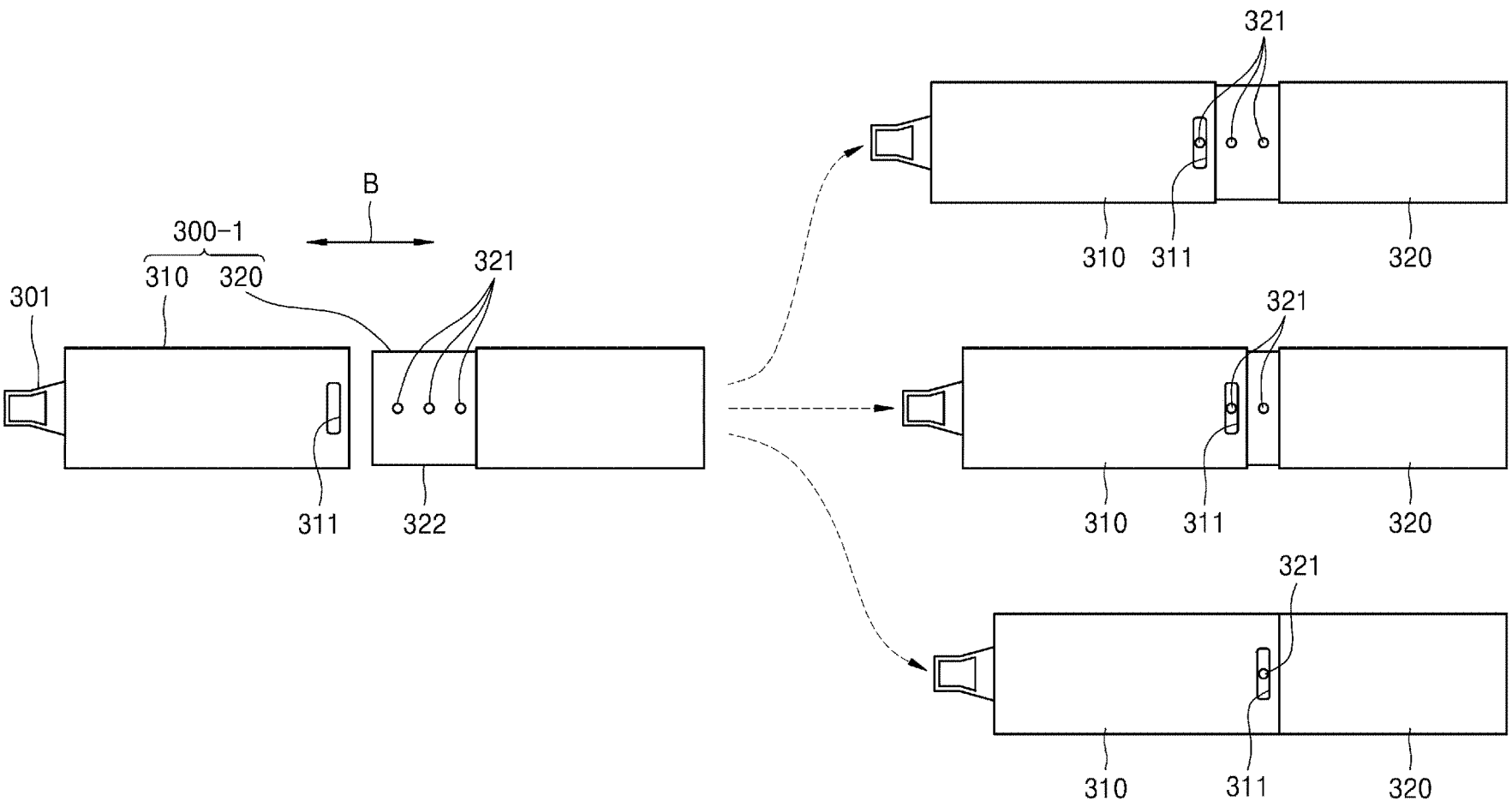
FIG. 7 shows an example of a volume adjustment member having an adjustable length.

FIG. 7 shows an example of a volume adjustment member 300-1 having an adjustable length. Referring to FIG. 7, the volume adjustment member 300-1 may include a first cylinder 310 and a second cylinder 320. The second cylinder 320 may be extendably coupled to the first cylinder 310 in the lengthwise direction B. For weight reduction, the first cylinder 310 and the second cylinder 320 may each be a hollow cylinder of which one end portion is blocked. Coupling protrusions 321 may be disposed apart from each other on any one of the first cylinder 310 and the second cylinder 320 in the lengthwise direction B. Coupling grooves 311, in which the coupling protrusions 321 are inserted, may be disposed on the other of the first cylinder 310 and the second cylinder 320. For example, a step portion 322 inserted inside the first cylinder 310 may be disposed on an open end portion of the second cylinder 320. The coupling protrusions 321 may be disposed on the step portion 322. The coupling grooves 311 may be disposed in the open end portion of the first cylinder 310. The connection ring 301 may be disposed on a closed end portion of the first cylinder 310, the connection ring 301 being connected to the extension portion 212 of the spring auger 200.

Due to the above structure, the step portion 322 of the second cylinder 320 is inserted into one end portion of the first cylinder 310, and one of the coupling protrusions 321 is inserted into the coupling grooves 311 so that the length of the volume adjustment member 300-1 may be adjusted.

Figure 8:
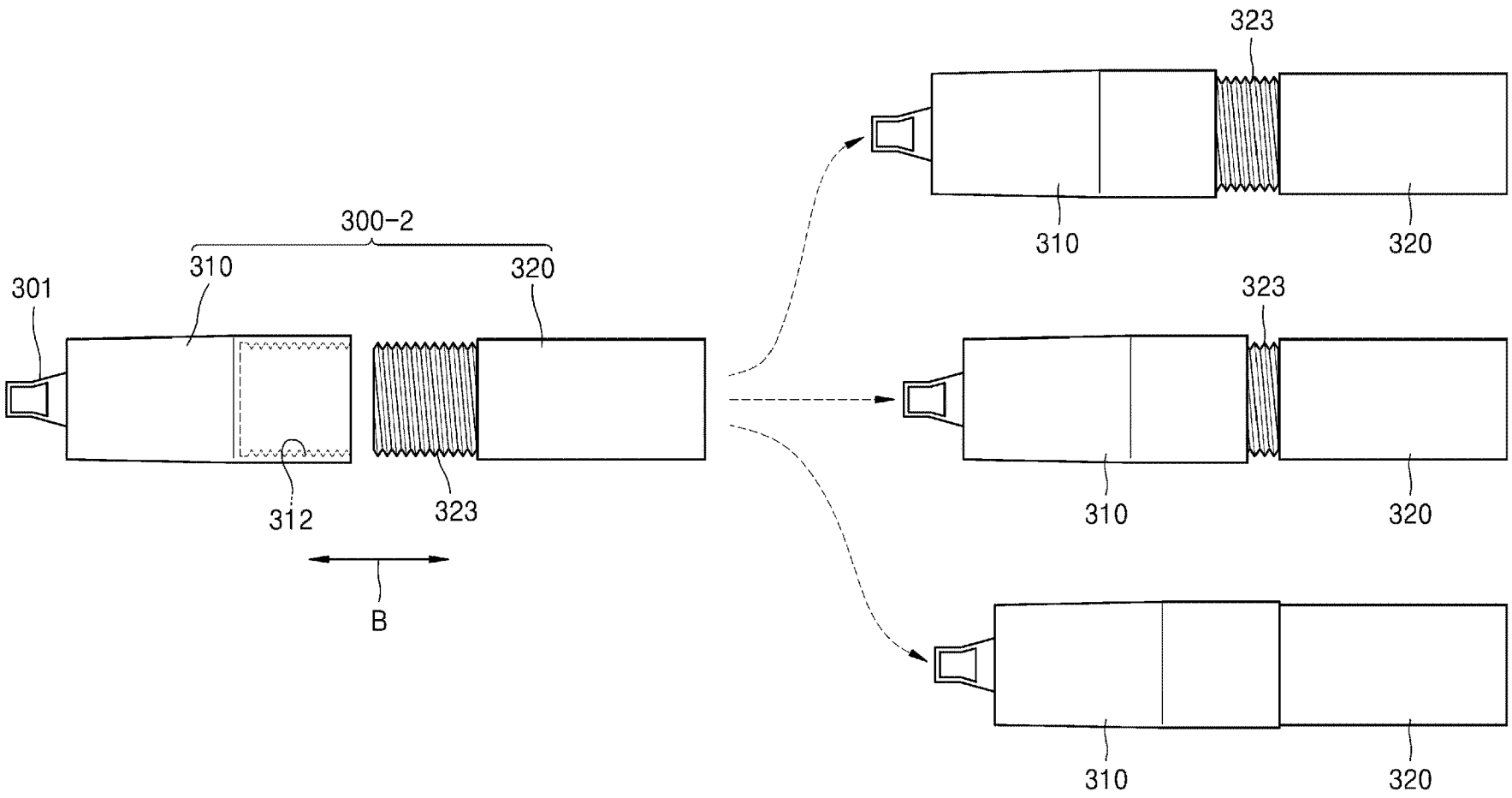
FIG. 8 shows an example of a volume adjustment member having an adjustable length.

FIG. 8 shows an example of a volume adjustment member 300-2 having an adjustable length. Referring to FIG. 8, the volume adjustment member 300-2 may include the first cylinder 310 and the second cylinder 320. The second cylinder 320 may be extendably connected to the first cylinder 310 in the lengthwise direction B. For weight reduction, the first cylinder 310 and the second cylinder 320 may each be a hollow cylinder of which one end portion is blocked. A female screw 312 may be disposed on the open end portion of any one of the first cylinder 310 and the second cylinder 320. A male screw 322 coupled to the female screw 312 may be disposed on the other of the first cylinder 310 and the second cylinder 320. For example, the female screw 312 may be disposed on the open end portion of the first cylinder 310, and the male screw 322 coupled to the female screw 312 may be disposed on the open end portion of the second cylinder 320. On the closed end portion of the first cylinder 310, the connection ring 301 connected to the extension portion 212 of the spring auger 200 may be disposed.

Due to the above structure, the length of the adjustment member 300-2 may be adjusted by adjusting a length of coupling the female screw 312 and the male screw 323.

Figure 9:
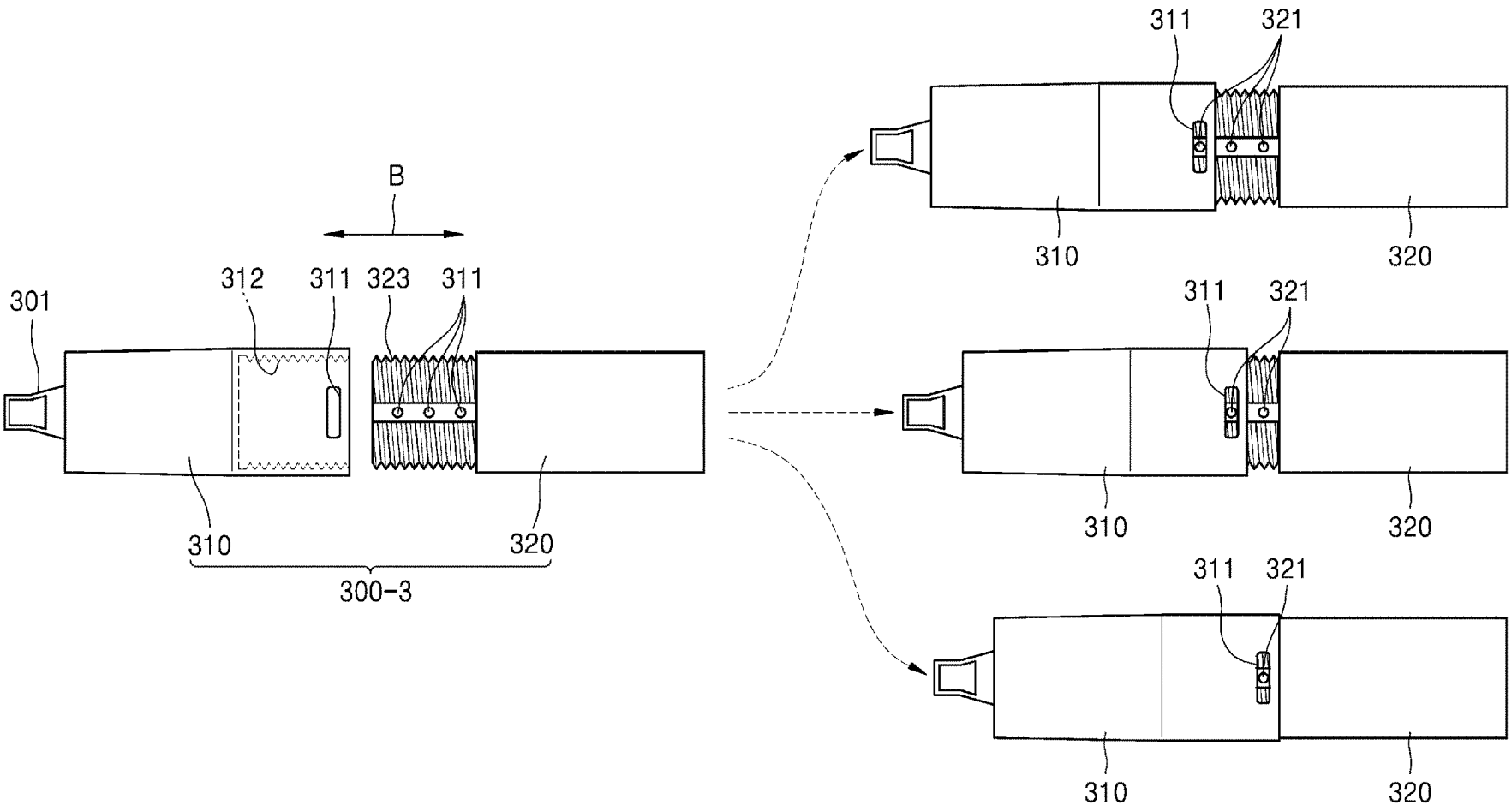
FIG. 9 shows an example of a volume adjustment member having an adjustable length.

FIG. 9 shows an example of a volume adjustment member 300-3 having an adjustable length. Referring to FIG. 9, the volume adjustment member 300-3 according to the present example is different from the volume adjustment member 300-2 of FIG. 8 in that the coupling protrusions 321 are disposed on the second cylinder 320 of the volume adjustment member 300-3 and the coupling grooves 311, in which the coupling protrusions 321 are inserted, are disposed in the first cylinder 310 of the volume adjustment member 300-3.

Due to the above structure, the length of the adjustment member 300-3 may be adjusted by adjusting a length of coupling the female screw 312 and the male screw 323 to allow one of the coupling protrusions 321 to be inserted into the coupling grooves 311.

Figure 10:
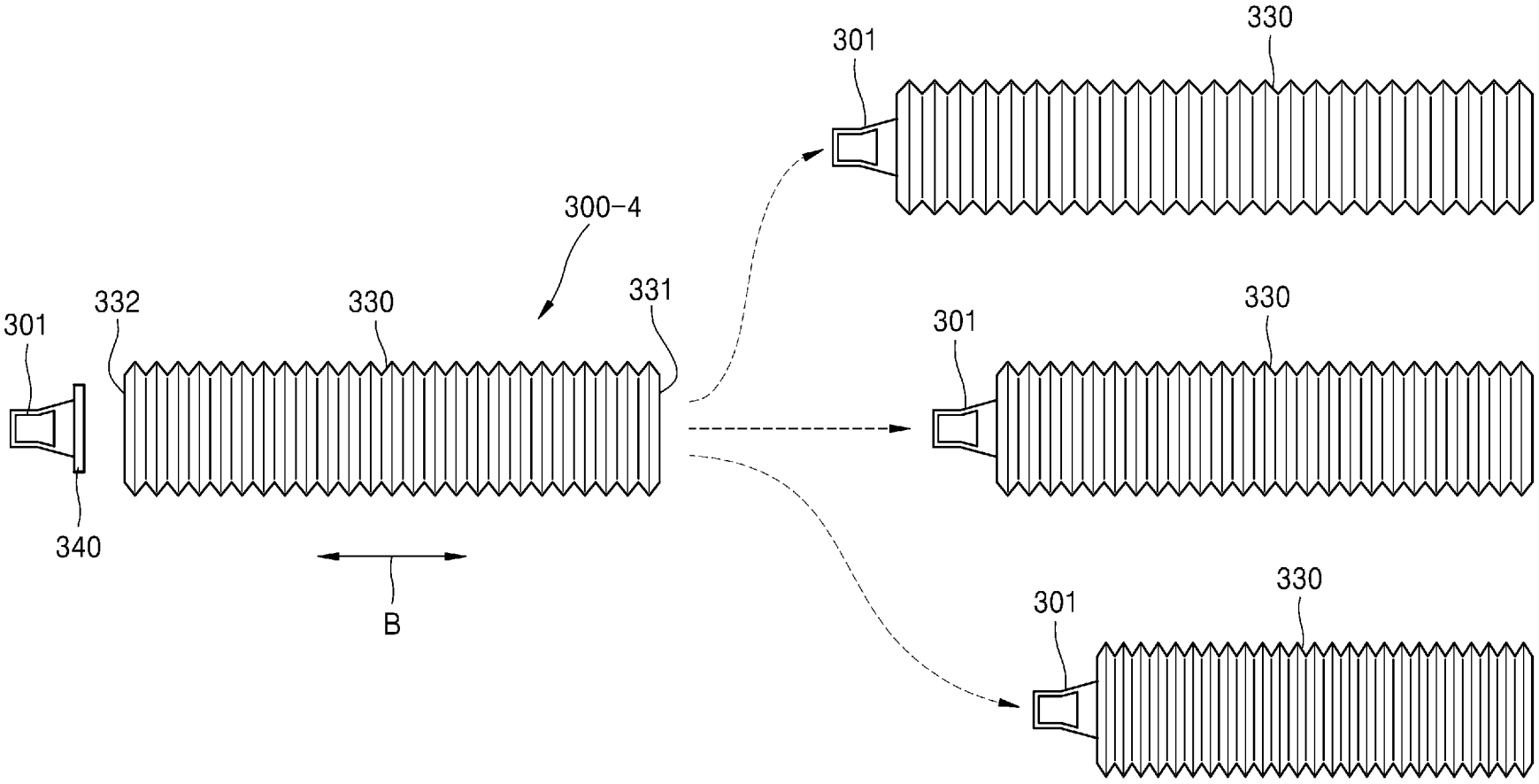
FIG. 10 shows an example of a volume adjustment member having an adjustable length.

FIG. 10 shows an example of a volume adjustment member 300-4 having an adjustable length. Referring to FIG. 10, the volume adjustment member 300-4 may include an extendable corrugated tube 330. On one end portion of the corrugated tube 330, a lid 340 that may be open and closed may be disposed. The corrugated tube 330 may be a hollow pipe. For example, the corrugated tube 330 may include a closed end portion 331 and an open end portion 332. When the corrugated tube 330 extends or contracts, air may flow in or out the corrugated tube 330 through the open end portion 332. The lid 340 may open or close the open end portion 332. The connection ring 301 may be disposed on the lid 340.

Due to the above structure, according to the necessity, the lid 340 may be separated from the corrugated tube 330, and the corrugated tube 330 is extended to a desired length. Then, the lid 340 is coupled to the open end portion 332 to adjust the length of the volume adjustment member 300-4.

It should be understood that embodiments described herein should be considered in a descriptive sense only and not for purposes of limitation. Descriptions of features or aspects within each embodiment should typically be considered as available for other similar features or aspects in other embodiments. While one or more embodiments have been described with reference to the figures, it will be understood by those of ordinary skill in the art that various changes in form and details may be made therein without departing from the spirit and scope as defined by the following claims.

What is claimed is:

1. A developer cartridge, comprising:

a housing to contain a developer and including a developer outlet at a first end portion in a lengthwise direction of the housing, the developer being dischargeable from the developer outlet;

a spring auger inside the housing and rotatable to transport the developer to the developer outlet;

a volume adjustment member inside the housing at a second end portion of the housing opposite to the developer outlet, the volume adjustment member to adjust an inside volume of the housing, wherein the volume adjustment member is inserted inside the spring auger and is maintained adjacent to the second end portion of the housing, and the volume adjustment member is to rotate together with the spring auger; and a rotation member to rotate the spring auger, wherein the spring auger comprises:

a connection portion connected to the rotation member, an extension portion extending from the connection portion in a radial direction, and a spiral portion extending from the extension portion in the lengthwise direction, wherein the volume adjustment member is connected to the extension portion to be movable in the radial direction to be rotated.

2. The developer cartridge of claim 1, wherein the volume adjustment member comprises a corrugated tube that is extendable.

3. The developer cartridge of claim 2, wherein the corrugated tube comprises a hollow pipe.

4. The developer cartridge of claim 1, wherein the volume adjustment member has an adjustable length to adjust a size of the volume adjustment member to adjust the inside volume of the housing.

5. The developer cartridge of claim 4, wherein:

the volume adjustment member includes a first cylinder that is hollow and a second cylinder that is hollow and is extendably connected to the first cylinder in the lengthwise direction.

6. The developer cartridge of claim 5, wherein:

a female screw is arranged on the first cylinder or the second cylinder, and a male screw corresponding to the female screw to couple to the female screw is arranged on another of the first cylinder or the second cylinder.

7. The developer cartridge of claim 5, wherein:

a plurality of coupling protrusions are arranged apart from each other in the lengthwise direction on the first cylinder or the second cylinder, and a plurality of coupling grooves are arranged on another of the first cylinder or the second cylinder to correspond to the coupling protrusions to allow the plurality of coupling protrusions to be inserted into the plurality of coupling grooves.

8. A developer cartridge comprising:

a housing to contain a developer and including a developer outlet at a first end portion in a lengthwise direction of the housing, the developer being dischargeable from the developer outlet;

a spring auger inside the housing and rotatable to transport the developer to the developer outlet; and a volume adjustment member inside the housing at a second end portion of the housing opposite to the developer outlet, the volume adjustment member to adjust an inside volume of the housing, wherein the volume adjustment member has an adjustable length to adjust a size of the volume adjustment member to adjust the inside volume of the housing, and wherein the volume adjustment member comprises a first section and a second section extendable coupled to the first section to adjust the length of the volume adjustment member.

9. The developer cartridge of claim 8, wherein:

the first section includes a first cylinder that is hollow, and the second section includes a second cylinder that is hollow and is extendably connected to the first cylinder in the lengthwise direction, a plurality of coupling protrusions are arranged apart from each other in the lengthwise direction on the first cylinder or the second cylinder, and a plurality of coupling grooves are arranged on another of the first cylinder or the second cylinder to correspond to the coupling protrusions to allow the plurality of coupling protrusions to be inserted into the plurality of coupling grooves.

10. The developer cartridge of claim 8, wherein:

the first section includes a first cylinder, and the second section includes a second cylinder that is extendably connected to the first cylinder in the lengthwise direction, a female screw is arranged on the first cylinder or the second cylinder, and a male screw corresponding to the female screw to couple to the female screw arranged on another of the first cylinder or the second cylinder.

11. The developer cartridge of claim 8, wherein the volume adjustment member comprises an antiskid member connected to the spring auger to prevent the volume adjustment member from being pushed towards the developer outlet due to thrust generated as the spring auger rotates, to maintain the volume adjustment member adjacent to the second end portion of the housing.

12. The developer cartridge of claim 11, wherein:

the antiskid member comprises a connection ring connected to the spring auger movably in a radial direction to rotate the volume adjustment member.

13. An image forming apparatus, comprising:

the developer cartridge of claim 8; and a print unit to receive the developer from the developer cartridge and print an image on a print medium according to an electrophotographic method.

14. A developer cartridge comprising:

a housing to contain a developer and including a developer outlet at a first end portion in a lengthwise direction of the housing, the developer being dischargeable from the developer outlet;

a spring auger inside the housing and rotatable to transport the developer to the developer outlet; and a volume adjustment member inside the housing at a second end portion of the housing opposite to the developer outlet, the volume adjustment member to adjust an inside volume of the housing, wherein the volume adjustment member has an adjustable length to adjust a size of the volume adjustment member to adjust the inside volume of the housing, and wherein the volume adjustment member is a corrugated tube that is extendable.

15. The developer cartridge of claim 14, comprising a lid on an end portion of the corrugated tube, wherein the lid is capable of being opened and closed.

16. The developer cartridge of claim 14, wherein the volume adjustment member comprises an antiskid member connected to the spring auger to prevent the volume adjustment member from being pushed towards the developer outlet due to thrust generated as the spring auger rotates, to maintain the volume adjustment member adjacent to the second end portion of the housing.

17. The developer cartridge of claim 16, wherein the antiskid member comprises a connection ring connected to the spring auger movably in a radial direction to rotate the volume adjustment member.

* * * * *